US006910621B2

(12) United States Patent
Shapiro et al.

(10) Patent No.: US 6,910,621 B2
(45) Date of Patent: Jun. 28, 2005

(54) EXPANDING FILE PORTFOLIO

(75) Inventors: Bruce Shapiro, Highland Park, IL (US); David Stone, Highland Park, IL (US); David Shapiro, Chicago, IL (US)

(73) Assignee: It's Academic of Illinois, Inc., Northbrook, IL (US)

( * ) Notice: Subject to any disclaimer, the term of this patent is extended or adjusted under 35 U.S.C. 154(b) by 100 days.

(21) Appl. No.: 10/281,640

(22) Filed: Oct. 29, 2002

(65) Prior Publication Data

US 2004/0079792 A1 Apr. 29, 2004

(51) Int. Cl.[7] ..... B65D 27/00
(52) U.S. Cl. ..... 229/67.1; 229/67.3; 229/67.4
(58) Field of Search ..... 229/67.1–67.4; 402/73; 281/4, 34

(56) References Cited

U.S. PATENT DOCUMENTS 1,444,811 A * 2/1923 Tarbox ..... 229/67.3
1,466,308 A * 8/1923 Livingston ..... 229/67.1
1,663,430 A * 3/1928 Wirt ..... 402/44
3,617,074 A * 11/1971 Rigolini et al. ..... 281/34
6,179,508 B1 * 1/2001 Coerver ..... 402/70
6,394,729 B2 * 5/2002 Welch ..... 412/3
6,607,215 B2 * 8/2003 Nomura ..... 281/22

* cited by examiner

*Primary Examiner*—Jes F. Pascua
(74) *Attorney, Agent, or Firm*—Wood, Phillips, Katz, Clark & Mortimer

(57) ABSTRACT

An expanding file portfolio that comprises a front panel member, a rear panel member and a spine member, all of which are made from a substantially rigid plastic material. The spine member has a base portion, a front section and a rear section. The front section of the spine member overlaps and is attached to a portion of the front panel member and the rear section of the spine member overlaps and is attached to a portion of the rear panel member. A divider insert member extends between the front panel member and the rear panel member.

15 Claims, 7 Drawing Sheets

EXPANDING FILE PORTFOLIO

FIELD OF THE INVENTION

The present invention relates to an expanding file portfolio that has a plurality of pockets for storage of various articles and materials. More specifically, the present invention relates to an expanding file portfolio that is made from substantially rigid plastic components and is of sturdy construction and is easy to manufacture.

BACKGROUND OF THE INVENTION

It has heretofore been the general practice to fabricate expanding file portfolios from flexible cardboard, fabric, plastic sheet material or the like. These prior art file portfolios are generally not of sturdy construction. There is a need for an expanding file portfolio that is made from substantially rigid components and is easy to manufacture.

SUMMARY OF THE INVENTION

The expanding file portfolio in accordance with a preferred embodiment of the invention includes a front panel member, a rear panel member and a spine member, all of which are preferably formed from a substantially rigid plastic material. The spine member comprises a base section having a front edge and a rear edge, a front section extending from the front edge and a rear section extending from the rear edge. The front section of the spine member overlaps and is attached to a portion of the front panel member and the rear section of the spine member overlaps and is attached to a portion of the rear panel member.

The front and rear sections are preferably respectively connected to the front and rear edges of the base section of the spine member by living hinges. The front and rear panel members are preferably formed with recessed portions on the outer surfaces thereof for respective receipt and attachment of the front and rear sections of the spine member by sonic welding or the like.

The rear panel member preferably includes a front flap section, a rear panel section, and a connecting section extending therebetween. The connecting section is provided with at least one transversely extending living hinge portion and preferably a plurality of spaced apart living hinge portions. The front flap portion is preferably formed with an opening therein for receipt of a latch member associated with the front section of the spine member.

In accordance with a preferred embodiment, a divider insert member extends between the front panel member and the rear panel member. The divider insert includes accordion side panels and spaced apart divider sheets extending therebetween. The divider insert member further includes a pair of front side flange portions and a pair of rear flange portions, which are respectively sonic welded to the front panel member and the rear panel member.

The base section of the spine member is preferably formed with spaced apart foot portions that permit the file portfolio to stand on the spine member and with a substantially flat portion for receipt of an identification label.

In accordance with a preferred embodiment, the latch member includes a pair of spaced apart latching elements that are integrally formed with the front section of the spine member. The latching elements are received through the opening in the front flap section of the rear panel member to secure the front flap section of the rear panel member to the front section of the spine member. The latch elements are preferably movable toward one another to permit withdrawal thereof through the opening in the front flap section of the rear panel member.

DETAILED DESCRIPTION OF PREFERRED EMBODIMENT

Referring to FIGS. 1–15, an expanding file portfolio constructed in accordance with the present invention is indicated generally at 10. Portfolio 10 is formed from a front panel member 12, a rear panel member 14, and a spine member 16, which members are preferably injection molded from a plastic material such as polypropylene, or the like. Portfolio 10 also includes a divider insert member 18.

Figure 4:
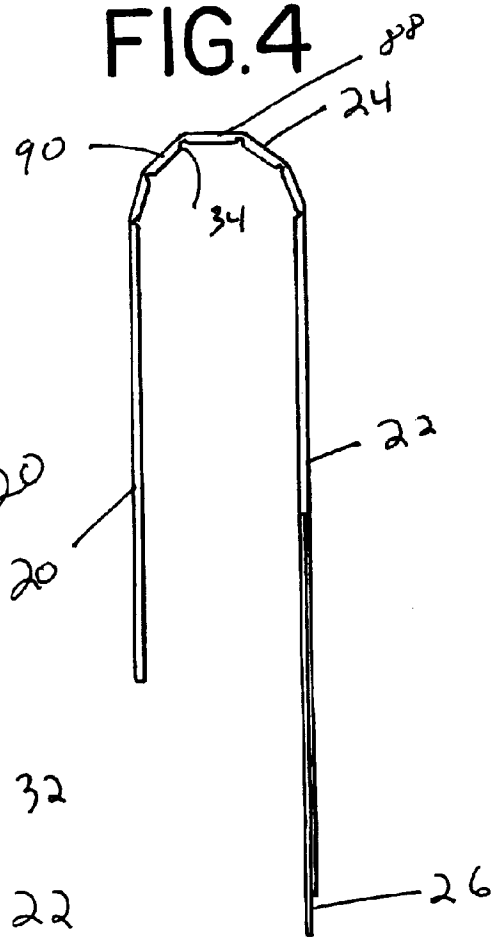
FIG. 4 is a right side elevational view of the rear panel member of FIG. 3.
Figure 3:
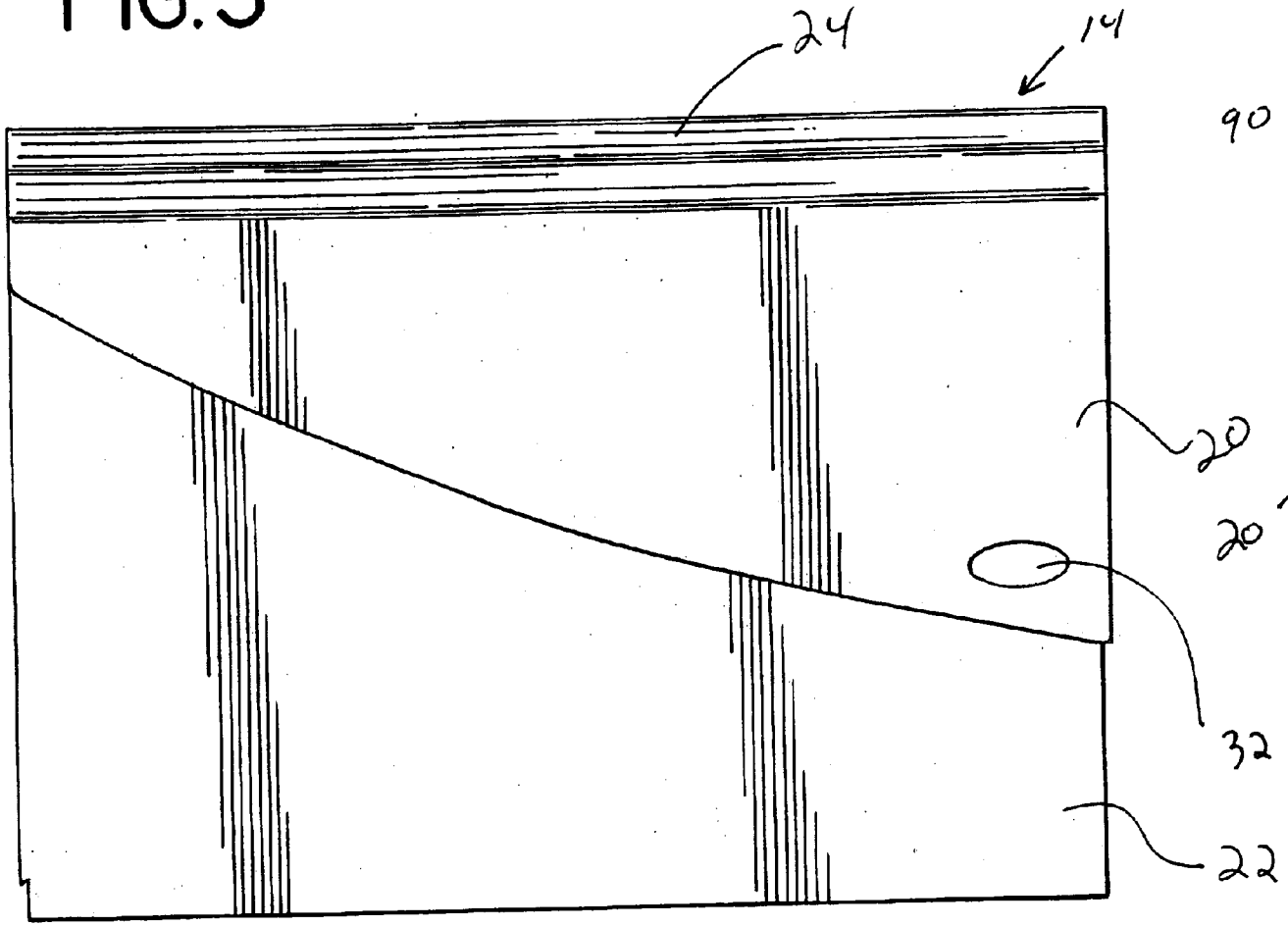
FIG. 3 is a front elevational view of the rear panel member.
Figure 5:
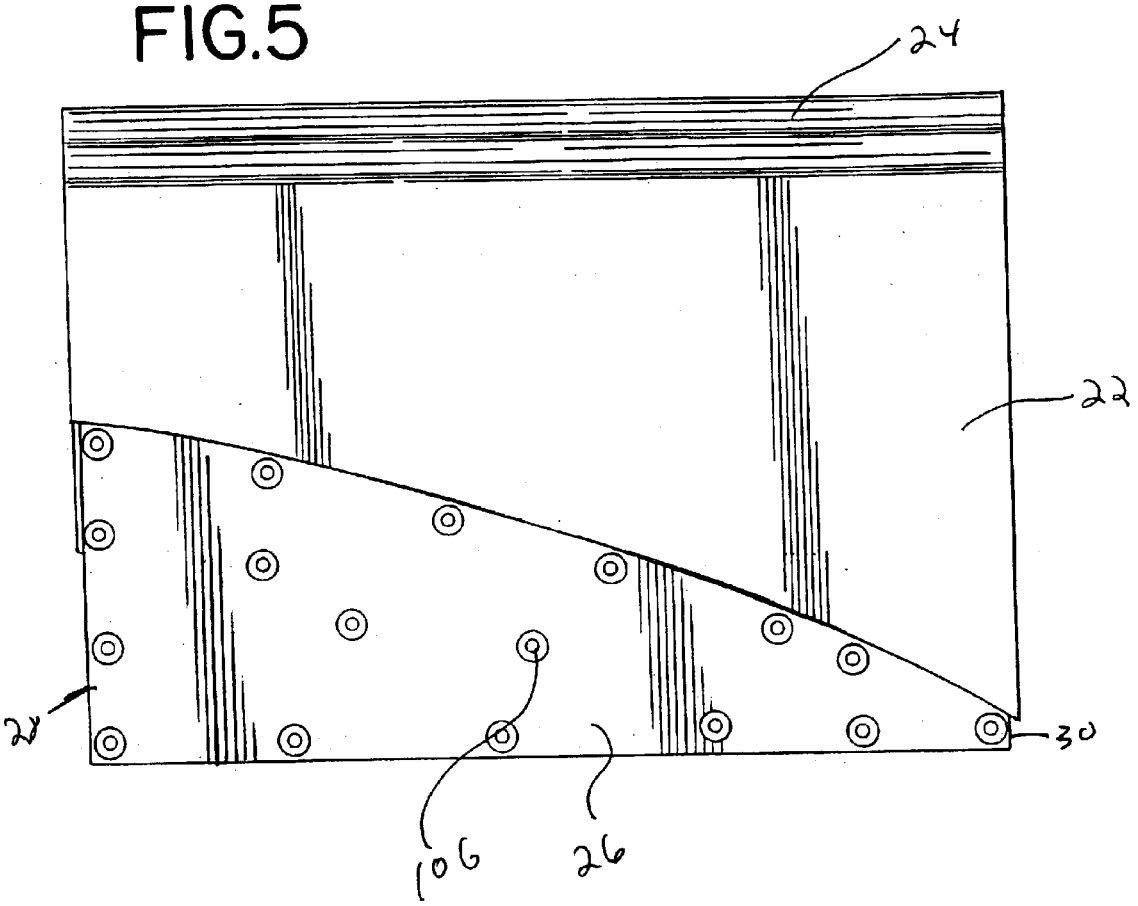
FIG. 5 is a rear elevational view of the rear panel member of FIG. 3.
Figure 6:
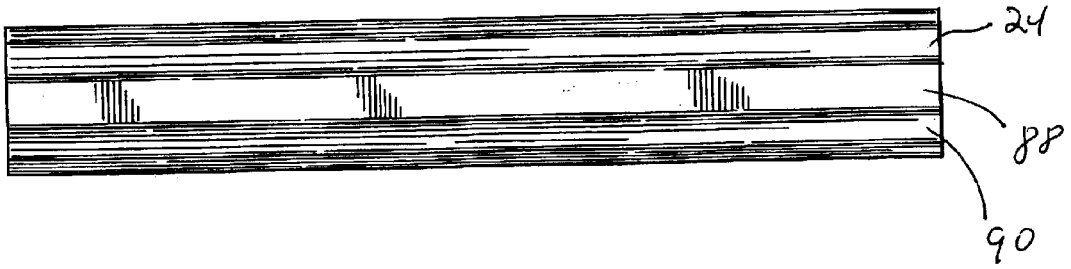
FIG. 6 is a top plan view of the rear panel member of FIG. 3.

Referring to FIGS. 3–6, rear panel member 14 includes a front flap section 20, a rear panel section 22 and a connecting section 24. As best seen in FIG. 5, rear panel section 22 is provided with a recess portion 26 formed in the outer surface thereof. The sidewalls 28 and 30 of recess portion 26 are slightly indented from the corresponding sidewalls of the remainder of the rear panel section. Front flap section 20 is formed with an opening 32 formed therein. As best seen in FIG. 4, connecting section 24 has a plurality of spaced apart, transversely extending living hinge portions 34 formed therein.

Figure 8:
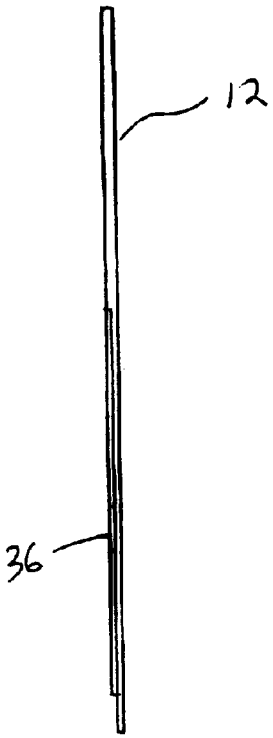
FIG. 8 is a right side elevational view of the front panel member of FIG. 7.
Figure 7:
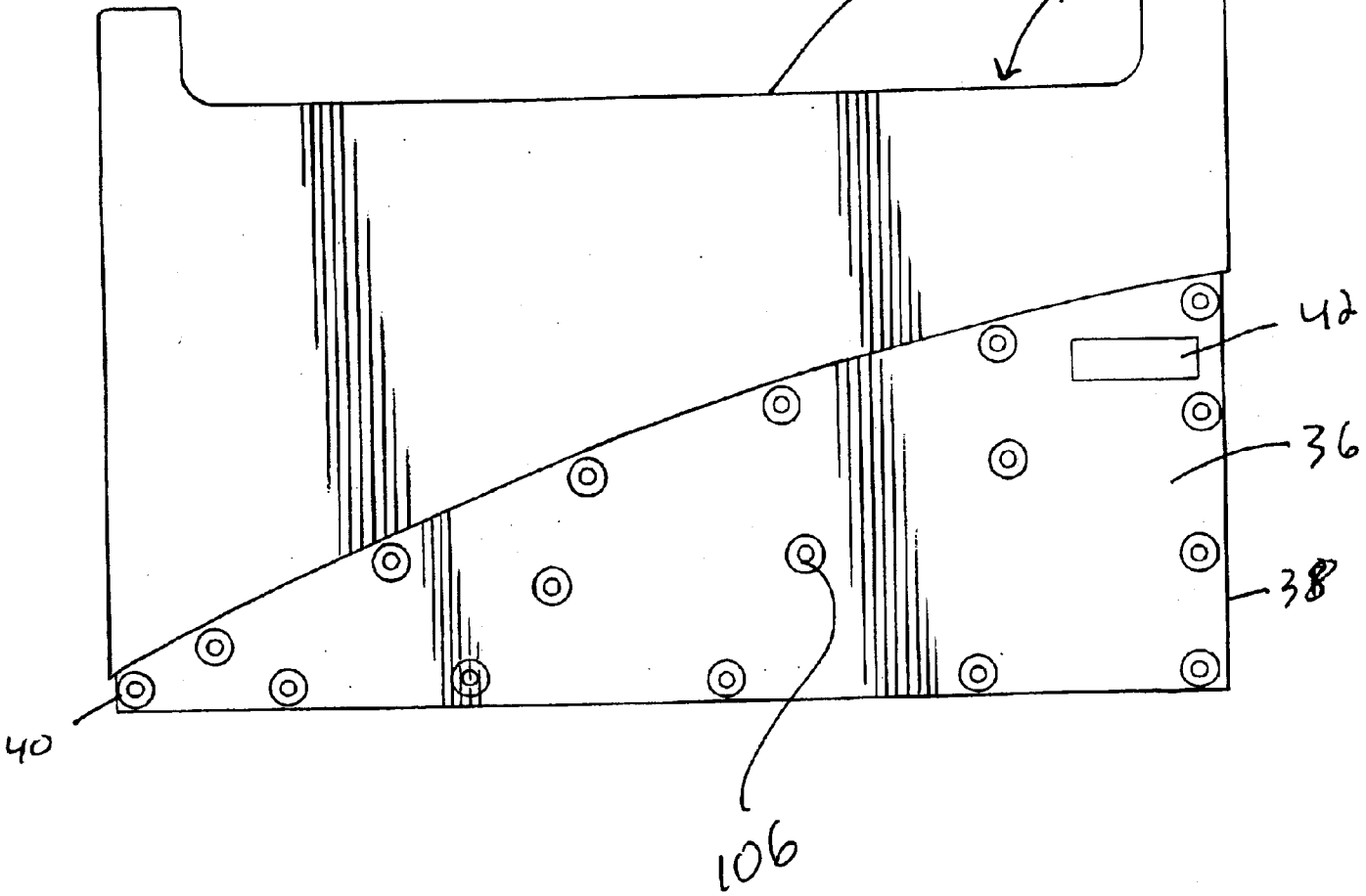
FIG. 7 is a front elevational view of the front panel member.

Referring to FIGS. 7–8, front panel member 12 is formed with a recess portion 36 in the outer surface thereof. The sidewalls 38 and 40 of recess portion 36 are slightly indented from the corresponding sidewalls of the remainder of the front panel member 12. A slightly raised rectangular portion is also formed in the recess portion 36. Front panel member 12 is also provided with a notched portion 44 formed along the upper edge thereof.

Figure 9:
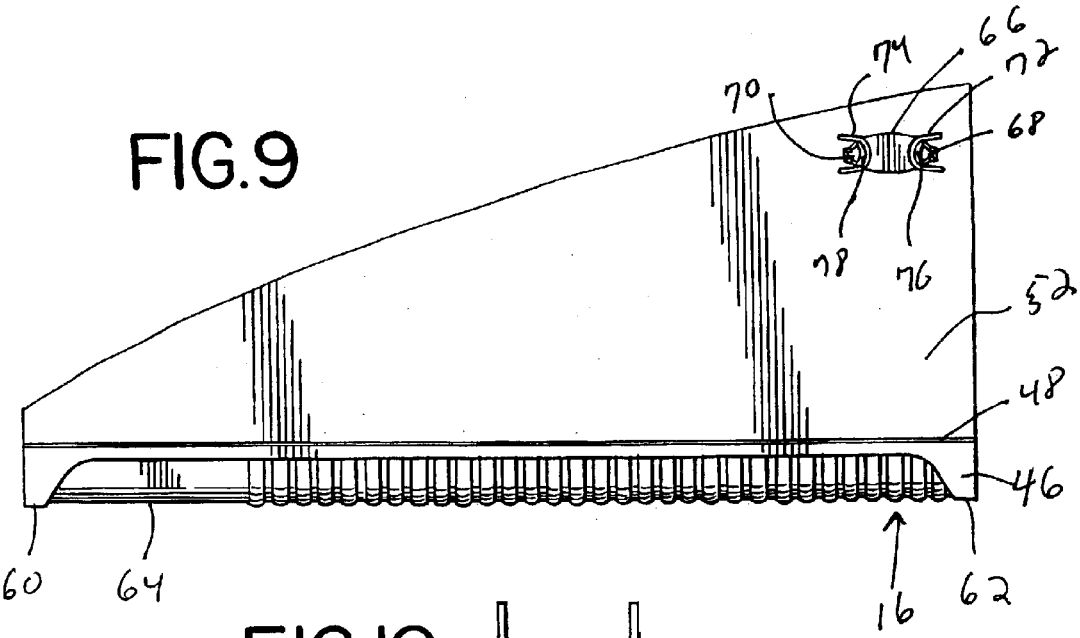
FIG. 9 is a front elevational view of the spine member.
Figure 10:
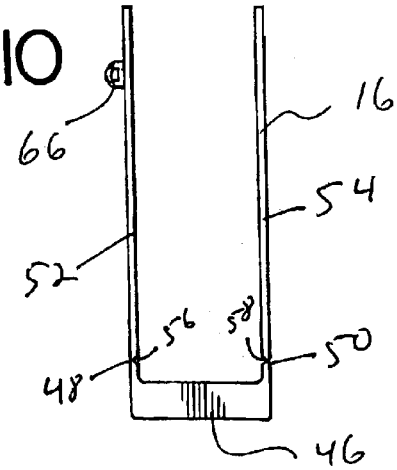
FIG. 10 is a side elevational view of the spine member of FIG. 9.
Figure 11:
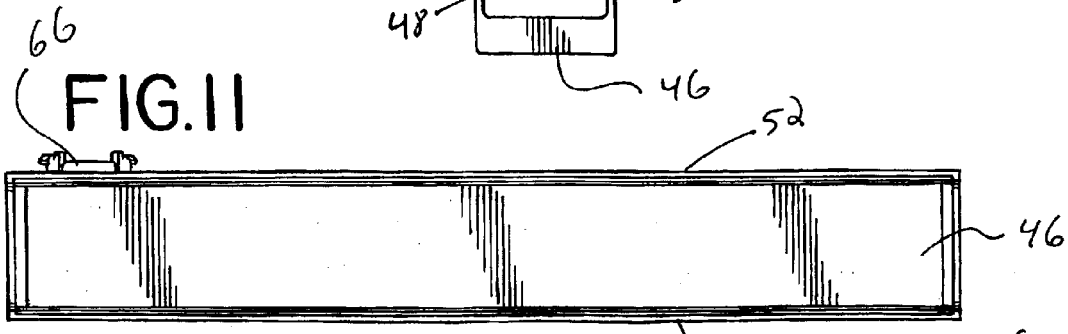
FIG. 11 is a top plan view of the spine member of FIG. 9.
Figure 12:
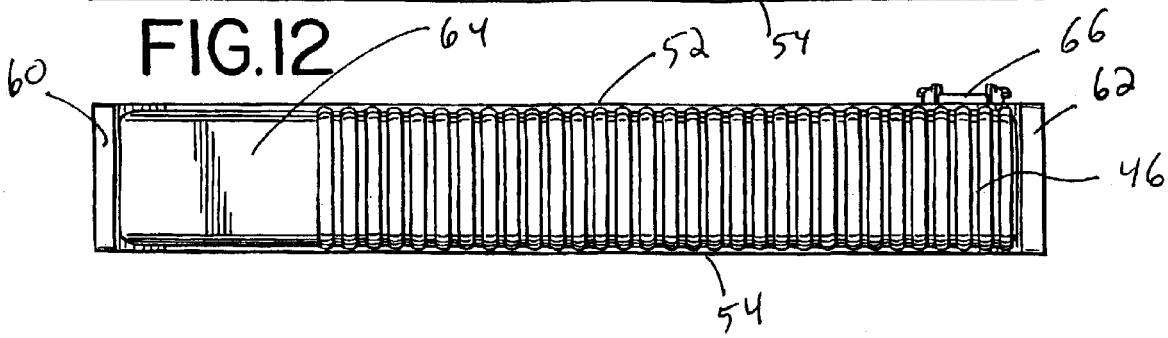
FIG. 12 is a bottom plan view of the spine member of FIG. 9.

Referring to FIGS. 9–12, spine member 16 includes a base section 46 that defines a front edge 48 and a rear edge 50. Spine member 16 further includes a front section 52 extending from the front edge 48 and a rear section 54 extending from the rear edge 50. Living hinge portions 56 and 58 are respectively formed adjacent the front section 52 and the front edge 48 and the rear section 54 and the rear edge 50, to permit relative movement between the front and rear sections and the base section 46. As best seen in FIGS. 9 and 12, the bottom surface of the base section 46 is formed with a pair of spaced apart foot portions 60 and 62 that permit the portfolio 10 to stand on the spine member 16. The bottom surface of the base section 46 is also formed with a substantially flat portion 64 for receipt of an identification label (now shown).

Figure 1:
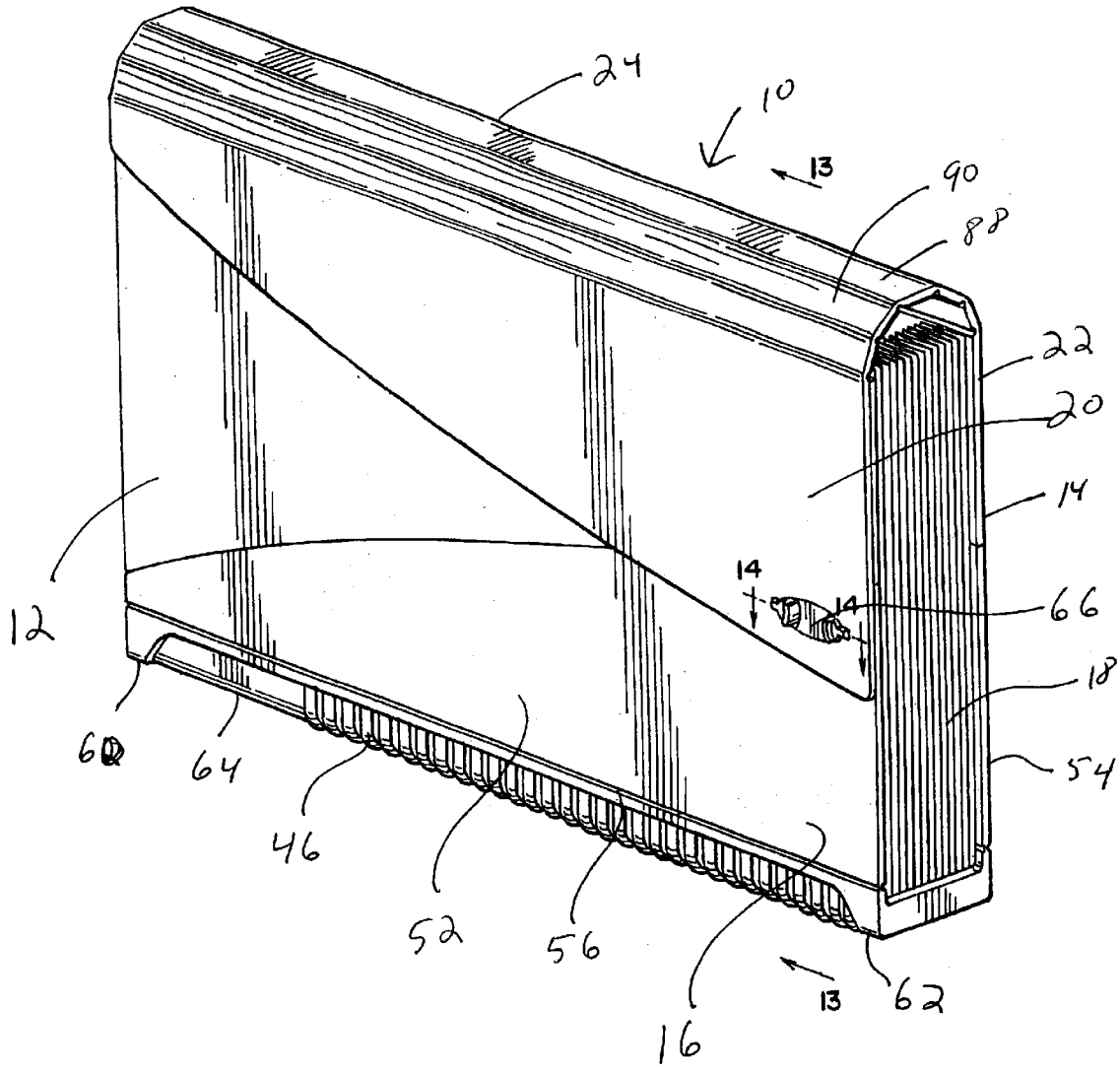
FIG. 1 is a perspective view of an expanding file portfolio according to a preferred embodiment, showing the expanding file portfolio in a closed condition.
Figure 14:
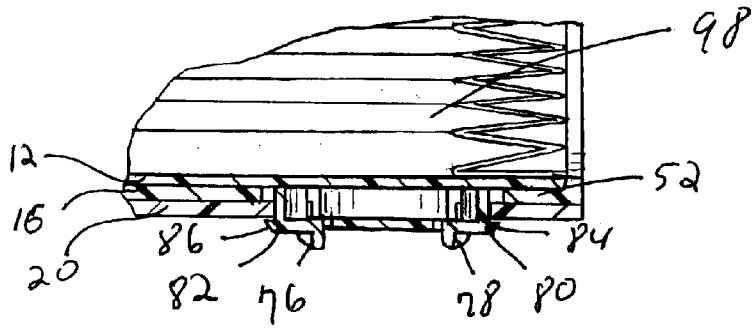
FIG. 14 is a cross-sectional view taken through lines 14—14 of FIG. 1.

As best seen in FIGS. 1, 9 and 14, the front section 52 of spine member 16 includes a latch member 66 that comprises a pair of spaced apart latching elements 68 and 70 that are integrally formed in the front section 52. Latching elements 68 and 70 are formed within generally U-shaped openings 72 and 74 so as to permit the latching elements to be movable toward one another. The latching elements are formed with raised curved portions 76 and 78 to facilitate movement of the latching elements. The latching elements 68 and 70 are further respectively formed with finger portions 80 and 82 which respectively have chambered edges 84 and 86 associated therewith.

Figure 15:
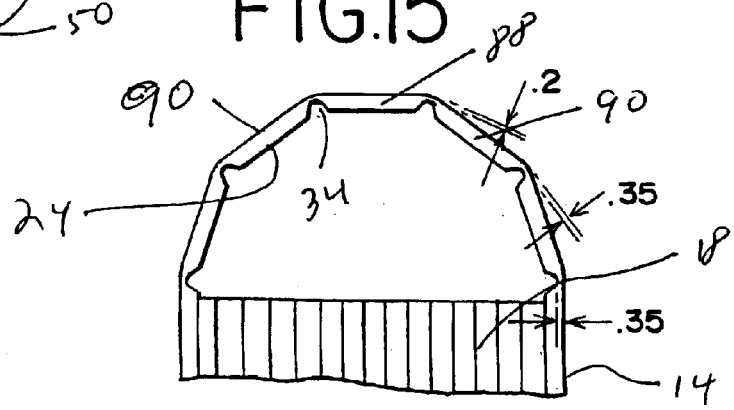
FIG. 15 is an enlarged side elevational view of an upper portion of the expanding file portfolio of FIG. 1.

Referring to FIG. 15, in accordance with a preferred embodiment of the invention, the connecting section 24 of the rear panel member 14 includes living hinge portions 34 formed therein to define a center section 88 and a pair of side sections 90 on either side thereof. In order to facilitate the opening and closing of the file portfolio 10, the thickness of the living hinge portions 34 adjacent to the center section 88 is less than the thickness of the other living hinge portion 34. In a most preferred embodiment, the thickness of the living hinge portions 34 adjacent to the center section 88 is about 0.2 millimeters and the thickness of the other living hinge portions is about 0.35 millimeters.

Figure 2:
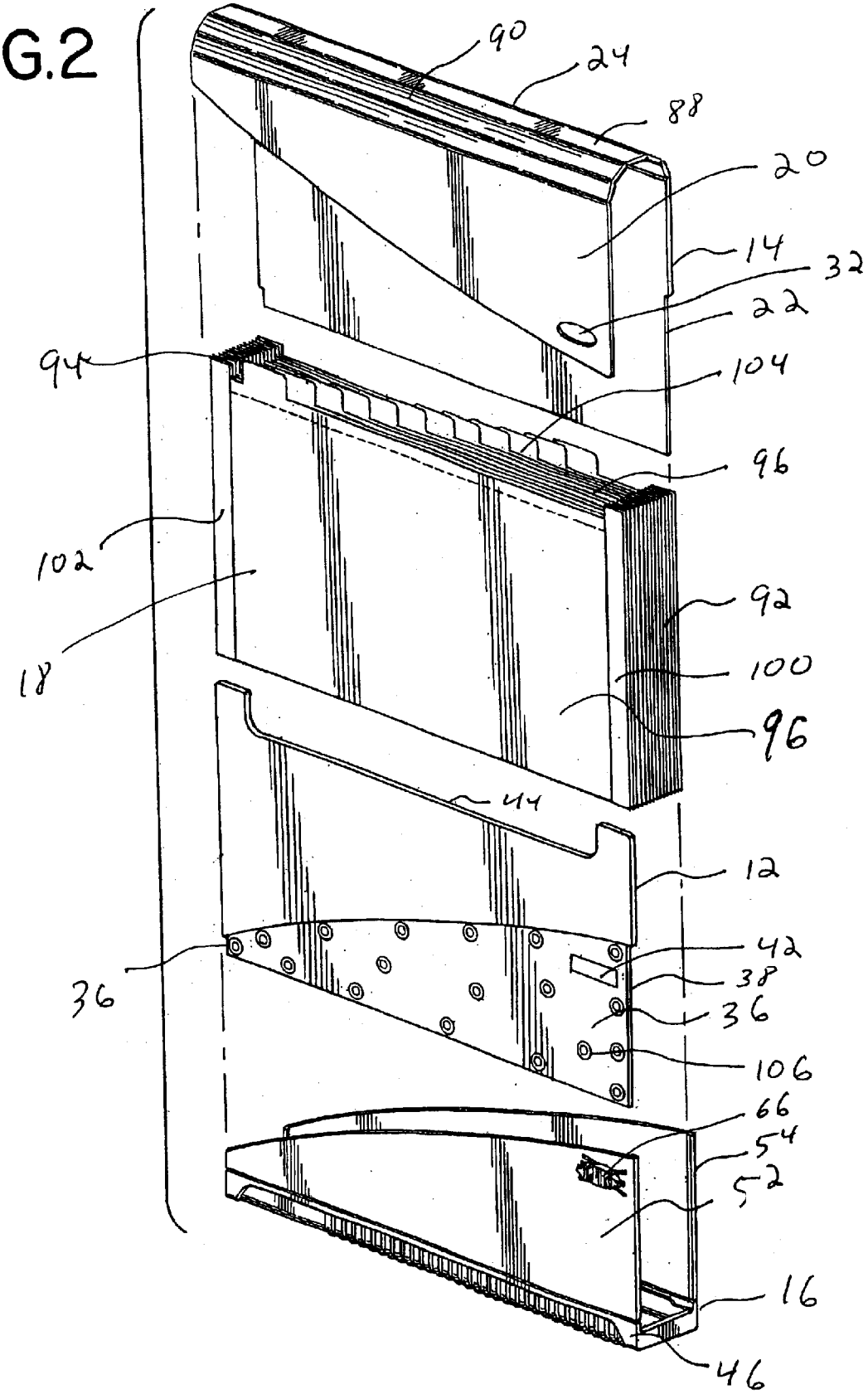
FIG. 2 is an exploded view of the expanding file portfolio of FIG. 1.
Figure 13:
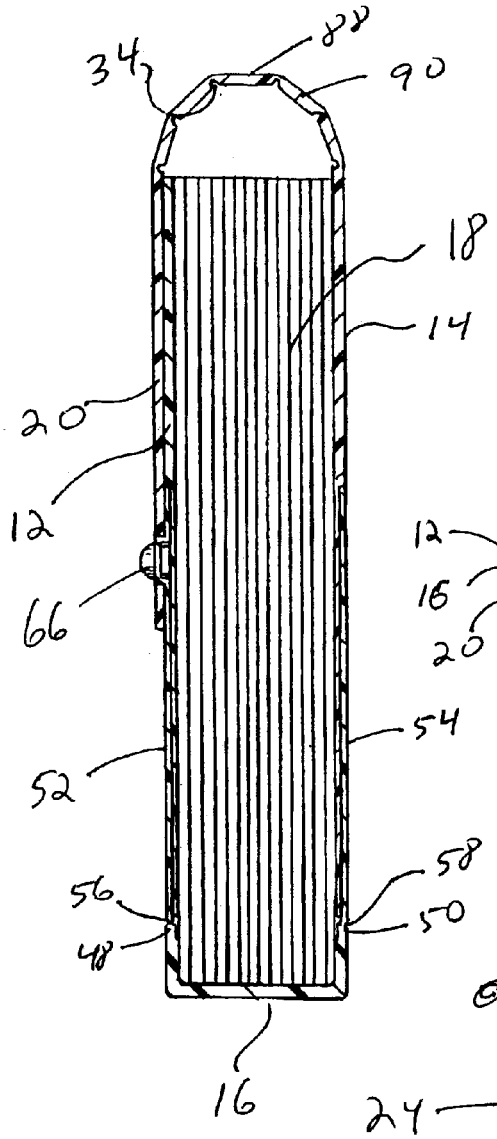
FIG. 13 is a cross-sectional view taken through lines 13—13 of FIG. 1.

Referring to FIGS. 2, 13 and 14, divider insert member 18 includes a pair of accordion side panels 92 and 94. Extending between the side panels 92 and 94 are a plurality of spaced apart divider sheets 96 suitably secured thereto so as to define pockets 98 therebetween. A pair of front side flange portions 100 and 102 and a pair of rear side flange portions (not shown) are respectively defined by the side panels 92 and 94. The divider sheets 96 are provided with conventional tabs 104.

Referring to FIG. 2, the assembly of the file portfolio 10 will now be discussed. As best seen in FIGS. 5 and 7, the respective recess portions 26 and 36 of rear panel member 14 and front panel member 12 are formed with energy concentration rings 106 to facilitate the sonic welding of these members to the spine member 16. The front section 52 of the spine member 16 is located in the recess portion 36 of the front panel 12 and is sonic welded thereto. The rear section 54 of the spine member 16 is located in the recess portion 26 of the rear panel member 14 and is sonic welded thereto. The divider insert member 18 is located between the front panel member 12 and the rear panel member 14 and the front side flange portions 100 and 102 are sonic welded to the front panel member and the rear side flange portions (not shown) are sonic welded to the rear panel member.

In operation of the file portfolio 10, the front flap section 20 of the portfolio is secured to the front section 52 via latch member 66 to close the portfolio. As best seen in FIG. 14, in operation, as the latch member 66 is directed through the opening 32 in front flap section 20, the chambered edges 84 and 86 of the finger portions 80 and 82 contact the edge portions defining the opening 32 and urge the latching elements 68 and 70 towards one other. As the latching elements 68 and 70 extend through the opening 32 they spring back to their static position and the finger portions 80 and 82 retain the front flap section 20 secured to the front section 52. When it is desired to open the portfolio 10, the latching elements 68 and 70 are urged towards one another, by applying a squeezing action through the curved portions 76 and 78, and the latch member 66 is withdrawn through opening 32 to permit the front flap section 20 to be moved into an opening position. In the open position the front and rear sections 52 and 54 are free to pivot about the living hinge portions 56 and 58 to permit access to the file portfolio.

Having described the invention in detail and by reference to the preferred embodiments thereof, it will be apparent that modifications and variations are possible without departing from the scope of the invention as defined in the appended claims.

What is claimed is:

1. An expanding file portfolio, comprising:

(a) a front panel member made from a substantially rigid plastic material;

(b) a rear panel member made from a substantially rigid plastic material; said rear panel member includes a front flap section, a rear panel section, and a connecting section extending between said front flap section and said rear panel section; and (c) a spine member made from a substantially rigid plastic material;

(d) said spine member comprising a base section having a front edge and a rear edge;

(e) said front section of said spine member overlapping and attached to a portion of said front panel member and said rear section overlapping and attached to a portion of said rear panel section;

(f) said front flan section has an opening formed therein for receipt of a latch member associated with the front section of said spine member.

2. An expandable file portfolio as defined in claim 1 wherein said front section of said spine member is connected to said front edge of said base section of said spine member by a living hinge portion.

3. An expandable file portfolio as defined in claim 1 wherein said rear panel portion is connected to said rear edge of said base portion by a living hinge portion.

4. An expandable file portfolio as defined in claim 1 wherein said front panel member has a recessed portion formed in an outer surface thereof for receipt of said front section of said spine member.

5. An expandable file portfolio as defined in claim 1 wherein said rear panel section has a recessed portion formed in an outer surface thereof for receipt of said rear section of said spine member.

6. An expandable file portfolio as defined in claim 1 wherein said connecting section is provided with at least one transversely extending living hinge portion.

7. An expandable file portfolio as defined in claim 1 further including a divider insert member extending between said front panel member and said rear panel member.

8. An expandable file portfolio as defined in claim 7 wherein said divider insert member includes accordion side panels and spaced apart divider sheets extending there between.

9. An expandable file portfolio as defined in claim 8 wherein said divider insert member includes a pair of front side flange portions and a pair of rear side flange portions which are respectively sonic welded to said front panel member and said rear panel member.

10. An expandable file portfolio as defined in claim 1 wherein said base section of said spine member is formed with spaced apart foot portions that permit the file portfolio to stand on said spine member.

11. An expandable file portfolio as defined in claim 1 wherein said base section of said spine member is formed with a substantially flat portion for receipt of an identification label.

12. An expandable file portfolio as defined in claim 1 wherein said rear panel member, and said spine member are injection molded from polypropylene material.

13. An expandable file portfolio as defined in claim 12 wherein said front panel member and said rear section of said spine member is sonic welded to a portion of said rear panel.

14. An expandable file portfolio as defined in claim 1 wherein said latch member includes a pair of spaced apart latching elements that are formed integrally with the front section of said spine member that are received through said opening in said front flap section of said rear panel member to secure said front flap section of said rear panel member to said front section of said spine member.

15. An expandable file portfolio as defined in claim 14 wherein said latch elements are movable toward one another to permit withdrawal thereof through said opening in said front flap section of said rear panel member.

* * * * *